US011828570B2

(12) United States Patent
Mueller

(10) Patent No.: US 11,828,570 B2
(45) Date of Patent: Nov. 28, 2023

(54) ADJUSTMENT TURRET HAVING INDICATOR RINGS

(71) Applicant: Leica Camera AG, Wetzlar (DE)

(72) Inventor: Sven Roman Mueller, Butzbach (DE)

(73) Assignee: Leica Camera AG, Wetzlar (DE)

( * ) Notice: Subject to any disclaimer, the term of this patent is extended or adjusted under 35 U.S.C. 154(b) by 184 days.

(21) Appl. No.: 17/266,487

(22) PCT Filed: Aug. 13, 2019

(86) PCT No.: PCT/DE2019/100725
§ 371 (c)(1),
(2) Date: Feb. 5, 2021

(87) PCT Pub. No.: WO2020/035110
PCT Pub. Date: Feb. 20, 2020

(65) Prior Publication Data

US 2021/0302127 A1 Sep. 30, 2021

(30) Foreign Application Priority Data

Aug. 15, 2018 (DE) ..... 102018119869.8

(51) Int. Cl.
*F41G 1/38* (2006.01)
*F41G 11/00* (2006.01)

(52) U.S. Cl.
CPC ..... *F41G 1/38* (2013.01); *F41G 11/00* (2013.01)

(58) Field of Classification Search
CPC ... F41G 1/16; F41G 1/38; F41G 11/00; G02B 23/00
USPC ..... 42/119, 122, 125
See application file for complete search history.

(56) References Cited

U.S. PATENT DOCUMENTS

| | | | | |
|---|---|---|---|---|
| 7,578,091 | B2 * | 8/2009 | Klepp | G02B 23/00 42/130 |
| 7,581,346 | B2 * | 9/2009 | Klepp | F41G 1/38 42/130 |
| 8,166,697 | B1 * | 5/2012 | Sueskind | F41G 1/38 42/122 |
| 8,904,696 | B2 * | 12/2014 | Geller | F41G 1/38 74/504 |
| 9,188,408 | B2 * | 11/2015 | Huynh | F41G 1/22 |
| 10,054,398 | B2 * | 8/2018 | White | F41G 1/38 |
| 10,724,829 | B1 * | 7/2020 | Ding | F41G 1/545 |
| 2004/0144013 | A1 | 7/2004 | Leatherwood | |
| 2007/0240356 | A1 | 10/2007 | Klepp et al. | |

(Continued)

FOREIGN PATENT DOCUMENTS

| | | | |
|---|---|---|---|
| AT | 516034 | A4 | 2/2016 |
| AT | 616034 | A4 | 2/2016 |

(Continued)

OTHER PUBLICATIONS

Patent Cooperation Treaty International Preliminary Report on Patentability PCT/DE2019/100725.

*Primary Examiner* — Joshua E Freeman
*Assistant Examiner* — Benjamin S Gomberg
(74) *Attorney, Agent, or Firm* — Schlee IP International, PC; Alexander R. Schlee; Pascal A. Schlee

(57) ABSTRACT

The invention relates to an adjustment turret having lockable and optionally freely adjustable scale/indicator rings and a symbolic display of the respectively locked or freely adjustable rings.

8 Claims, 8 Drawing Sheets

(56) References Cited

U.S. PATENT DOCUMENTS

| | | | | |
|---|---|---|---|---|
| 2008/0289239 | A1* | 11/2008 | Menges | F41G 1/40 42/125 |
| 2016/0274619 | A1 | 9/2016 | Windauer | |
| 2017/0254620 | A1* | 9/2017 | Dasukevich | F41G 1/473 |
| 2023/0099212 | A1* | 3/2023 | Toy | F41G 1/38 42/119 |

FOREIGN PATENT DOCUMENTS

| | | | |
|---|---|---|---|
| DE | 202012012707 | U1 | 9/2013 |
| DE | 102017129682 | A1 | 6/2019 |

* cited by examiner

ADJUSTMENT TURRET HAVING INDICATOR RINGS

CROSS-REFERENCE TO RELATED APPLICATION

This application is a national phase entry under 35 USC 371 of the international patent application PCT/DE2019/100725 filed on Aug. 13, 2019 and published under the publication number WO 2020/035110, claiming the priority right from the German patent application DE 102018119869.8 filed on Aug. 15, 2018.

BACKGROUND OF THE INVENTION

The invention relates to an adjustment turret with indicator rings. Such adjustment turrets may be provided with a saddle preferably for mounting to the housing of a rifle scope; an actuator that is displaceable out of the saddle along a symmetry axis of the adjustment turret in a non-rotatable fashion; a threaded fitting coupled to the base for the displacement of the actuator, wherein the base is rotatably mounted to the saddle; an adjustment ring coupled to the base; a scale ring that is supported on the base in such fashion that is lockable and/or rotatable relative to a reference marking arranged on the saddle; and at least one indicator ring adjustably mounted to the base;

Adjustment turrets of this kind are especially known in the field of rifle scopes, where the reticle adjustment is set according to varying shooting ranges and/or varying ammunition types. Therein, an actuator activated by the adjustment turret acts on the bearing of the reticle in the optical path of the rifle scope. Such an adjustment turret is also known from the prior application DE 10 2017 129 682.4.

By means of an adjustment wheel at the adjustment turret, a scale is rotated relative to a reference marking fixed with respect to the rifle scope. By lifting the adjustment wheel, the lock on the adjustment turret scale is unlocked and brought to a zero-position or to an appropriate position for a different shooting range and/or ammo type.

It is known, for example from EP 1 959 221 B1, to arrange colored indicator rings over a scale ring at the adjustment turret for displaying the setting adjustments for different shooting ranges and/or ammo types. For the adjustment of indicator rings, a cap must be removed from the adjustment turret and the at least one indicator ring must be removed. For radial orientation of the indicator rings, the adjustment turret includes an outer central gear and the indicator rings include an internal gear. According to the corresponding radial position setting, the gears can be inserted into each other. After positioning all indicator rings, the cap is put back on so that the indicator rings are secured against unintentional adjustment of their radial position.

SUMMARY OF THE INVENTION

An object of the invention is to enable rotation of the scale with the actuator by means of the adjustment wheel, as well as resetting the scale to zero without changing the height of the adjustment turret and without requiring use of special tools. Similarly, different indicator rings should be adjustable radially with the respect to the scale individually and independently of one another without any additional assembly and without jeopardizing their rotational position.

According to an aspect of the invention, an adjustment turret with indictor rings comprises: a saddle preferably for mounting to the housing of a rifle scope; an actuator that is displaceable out of the saddle along a symmetry axis of the adjustment turret in a non-rotatable fashion; a threaded fitting coupled to the base for the displacement of the actuator, wherein the base is rotatably mounted to the saddle; an adjustment ring coupled to the base; a scale ring that is supported on the base in such fashion that it is lockable and/or rotatable relative to a reference marking arranged on the saddle; at least one indicator ring adjustably mounted to the base; a display disc is arranged in the upper surface of the adjustment ring and is securely coupled to the base, wherein underneath the display disc a cam disc is provided that is rotatable about the symmetry axis of the adjustment turret, said cam disc comprising at least one arc-shaped cam facing the base, including a rise/fall ramp acting in a rotational direction; and at least one rotatably fixed and longitudinally displaceable lock slide is arranged parallel to the symmetry axis of the adjustment turret at a circumference of the base, which lock slide is axially displaceable by one of the cams of the cam disc.

DETAILED DESCRIPTION OF THE INVENTION

The inventive adjustment turret with indicator rings comprises a mounting saddle, preferably for mounting to the housing of a rifle scope. A rotatably fixed actuator is a slidable out of the saddle along a symmetry axis of the adjustment turret, for example for the vertical adjustment of an inversion system of art e scope with a reticle. A threaded fitting is coupled to a base for the adjustment of the actuator, wherein the base is rotatably mounted on the saddle. The adjustment ring is coupled to the base, which is not rotatable when locked and is rotatable when unlocked, wherein via the base a rotation causes an axial adjustment of the actuator. A rotatably mounted scale ring is located on the base, which is rotatable by turning the adjustment turret relative to a reference marking on the saddle. Additionally, at least one adjustably mounted indicator ring is provided on the base. A display disc securely coupled to the base is located in the surface of the adjustment ring, and underneath the display disc is a cam disc rotatable about the symmetry axis of the adjustment turret. The cam disc is intended to be the setting means with multiple rotation positions corresponding to different functions and further includes different function symbols on its top side, which are optionally visible to the user through a window in the display disc. In a first locked setting, an unintentional rotation of the adjustment ring with the display disc is not possible. In this setting (rotational default position of the cam disc), neither the scale ring nor the indicator ring can be adjusted.

In a second unlocked setting ($2^{nd}$ rotational position of the cam disc), the setting of for example a reticle means by rotation of the adjustment ring and thereby limited axial displacement of the actuator is unlocked/enabled. A rotation of the adjustment ring simultaneously rotates the display disc, the cam disc, the scale ring and an indicator ring. This means that also in this setting neither the scale ring nor the indicator ring can be adjusted or aligned with each other through relative rotation.

In a further setting (3rd rotational position of the cam disc), rotation of the adjustment ring, and thereby also of the display disc, is impeded. This unlocks/enables setting of the scale ring through relative rotation with respect to the base, while the setting of the indicator ring continues to be impeded.

In a further setting (4th rotational position of the cam disc), the rotation of the adjustment ring is likewise impeded by the display disc, while a setting of the indicator ring is freed through relative rotation relative to the base and therewith also relative to the scale ring. Setting the remaining elements such as the adjustment ring and scale ring is not possible.

In further settings (further rotational positions of the cam disc), the setting of additional indicator rings can be adjusted.

Thus, user operating error is advantageously prevented through clear functional allocation by rotational positions of the cam disc.

Positioned at the cam disc is at least one arc-shaped, base-facing cam including a rise/fall ramp extending in the rotational direction.

For optional locking or release, at least one fixed and longitudinally displaceable lock slide is arranged parallel to the symmetry axis of the adjustment turret at the peripheral circumference of the base, wherein the lock slide is axially displaceable along the cam of the cam disc.

BRIEF DESCRIPTION OF THE DRAWINGS

An embodiment is schematically shown in the drawings. These show.

DETAILED DESCRIPTION OF THE DRAWINGS

A fundamental idea of the invention is the arrangement of a manually rotatable cam disc within the upper surface of the adjustment ring and the cam disc's selective operation of the axial adjustment of the adjustment turret, the scale ring and individual lock slides allocated to respective indicator rings.

Figure 1:
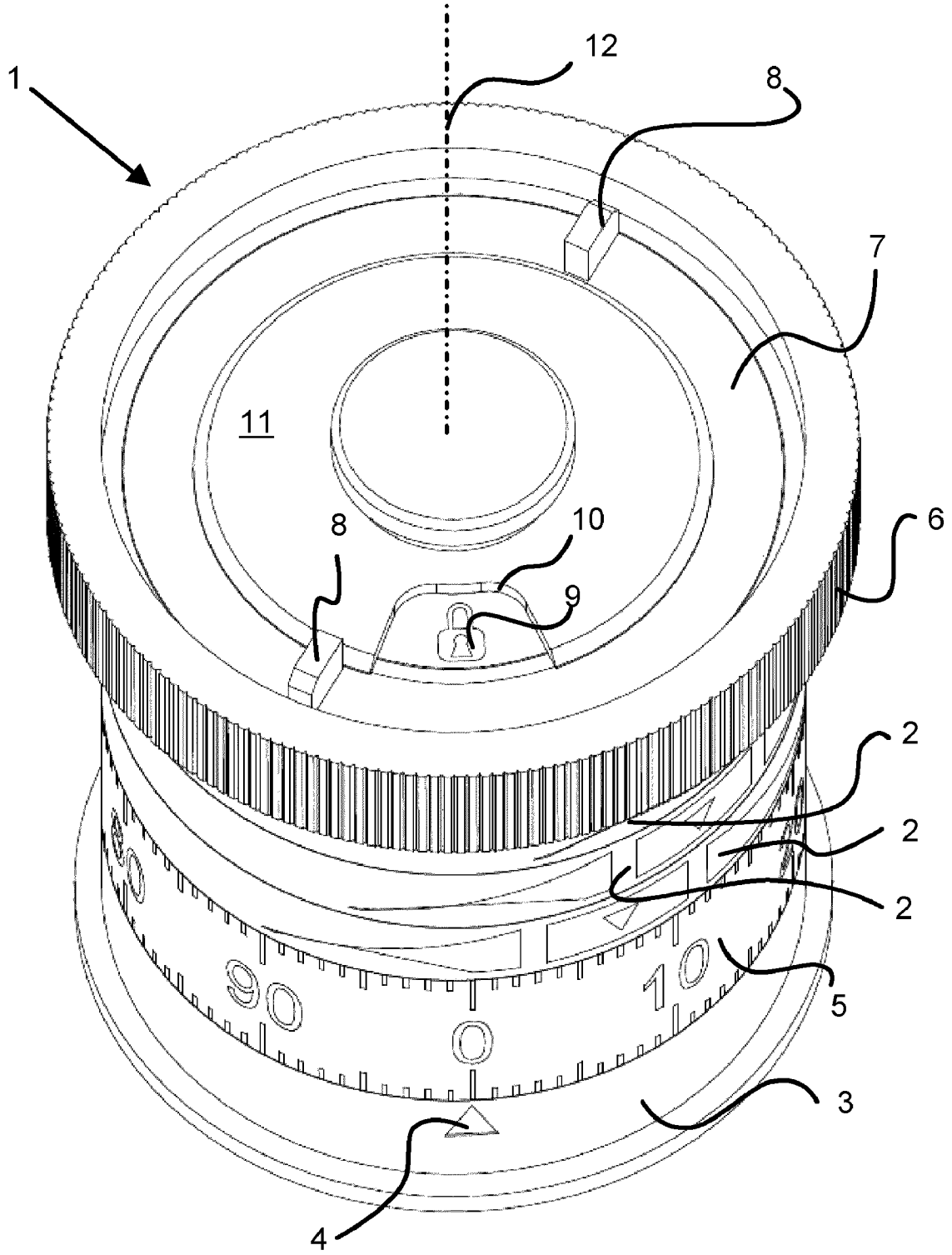
FIG. 1 a perspective view of the adjustment turret with indicator rings.

The view presented in FIG. 1 shows an adjustment turret 1 with indicator rings 2. The adjustment turret includes particularly a fixed saddle 3 having reference markings 4 and being fixed to the housing of a rifle scope. On the saddle 3, a scale ring 5 is provided that is optionally fixable or rotatable with respect to the reference marking 4.

An adjustment ring 6 with a knurling for improved grip is provided at the upper part of the adjustment turret 1. A cam disc 7 is rotatably mounted inside the upper side of the adjustment ring 6 and rotatable via manual grip of knobs 8. The cam disc 7 includes display symbols 9 which optionally are visible through a window 10 on a display disc 11. The adjustment ring 6 is securely coupled to the base 13 via the display disc 11. The adjustment ring 6 and the cam disc 7 are rotatable about a symmetry axis 12. The cam disc 7 is rotatable independently of the adjustment ring 6. A rotation of the adjustment ring 6 is conveyed to cam disc 7, the display disc 11, and the base 13 for the adjustment of the actuator 15.

Figure 2:
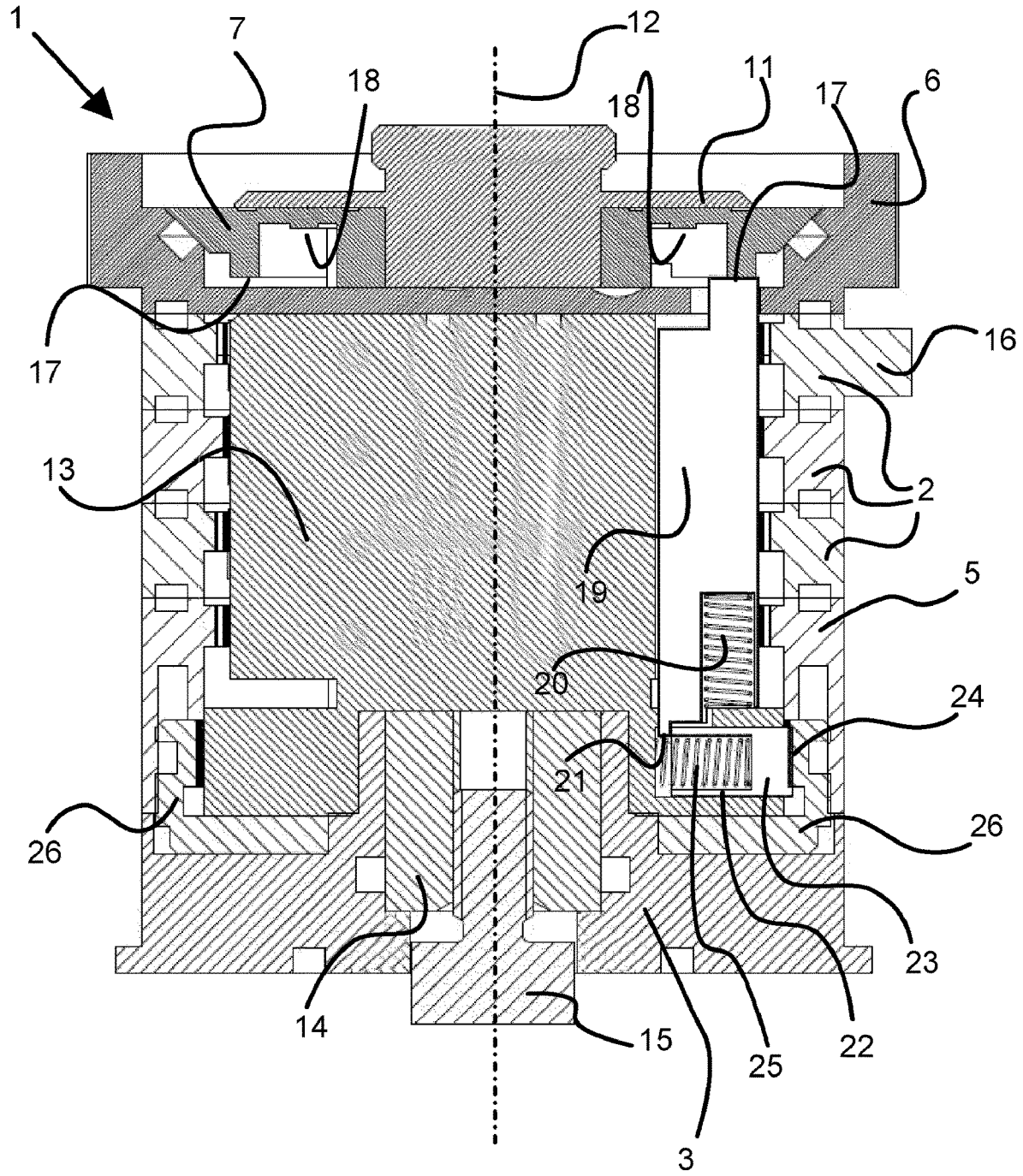
FIG. 2 a cross-sectional view of the adjustment turret with turret lock slides, FIG. 2*a* a detailed sectional view of the lock of the base with the saddle, FIG. 2*b* a detailed sectional view of unlocking by the turret lock slide, FIG. 3 a cross-sectional view of the adjustment turret with scale and indicator ring lock slides, FIG. 4 a perspective view of the base with lock slides, FIG. 5 a plan view of the upper surface of the cam disc, FIG. 6 a perspective view of the bottom surface of the cam disc, FIG. 7 a detailed sectional view with alternative display disc, and cam disc of an adjustment turret, and FIG. 7*a* an enlarged area from FIG. 7.

A cross-sectional view of the adjustment turret 1 shown in FIG. 2 shows a cylindrical body as base 13. The base 13 is rotatably mounted on the saddle 3. A threaded fitting 14 is securely coupled to the base 13. An actuator 15 is screwed into the threaded fitting 14, which actuator can be, along symmetry axis 12, screwed out of or into the saddle 3 by rotating the base 13. Additionally, an actuator 15 is guided in a non-rotatable fashion either directly in the saddle 3 or is non-rotatably secured through engagement with a cam that is fixed with respect to the saddle 3 according to known methods. The cross-sectional form of the front part of the actuator 15 can be fitted to the cam.

A scale ring 5 and multiple indicator rings 2 are rotatably mounted on top of each other on the base 13. The indicator rings 2 can include a setting protrusion 16, which is particularly advantageous for gripping of the indicator rings 2 having a relatively low height.

The adjustment ring 6 and the display disc 11 are securely coupled to the base 13. The cam disc 7 is rotatably mounted between the display disc 11 and the surface of the adjustment ring 6 that is coupled to the base 13.

The display disc 11 and the upper surface of the cam disc 7 are shown as a level surface in FIG. 2. Advantageously they can, such as is diagramed schematically and as a detailed section in FIGS. 7, 7*a*, be shaped as on one another laying tapered surfaces with surfaces extending at an incline with respect to the symmetry axis 12. This advantageously enables a lateral view through the window 10.

The underside of the cam disc 7 comprises cams 17, 18 arranged concentrically to each other. The cam 17 engages as a turret cam 17 the upper part of a turret lock slide 19. The turret lock slide 19 extends in parallel to the symmetry axis 12 and is arranged relatively to the base 13 at its peripheral edge in a non-rotatable and longitudinally movable fashion. A return spring 20 supported against the base 13 pushes the upper part of the turret lock slide 19 upwards.

Figure 2A:
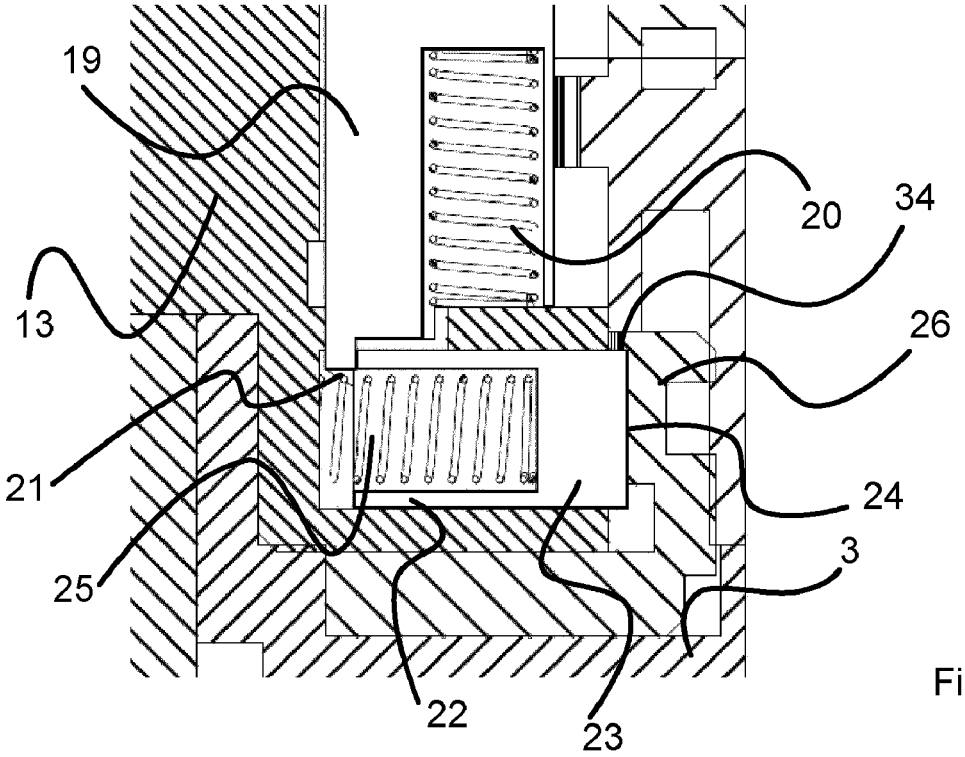
Figure 2B:
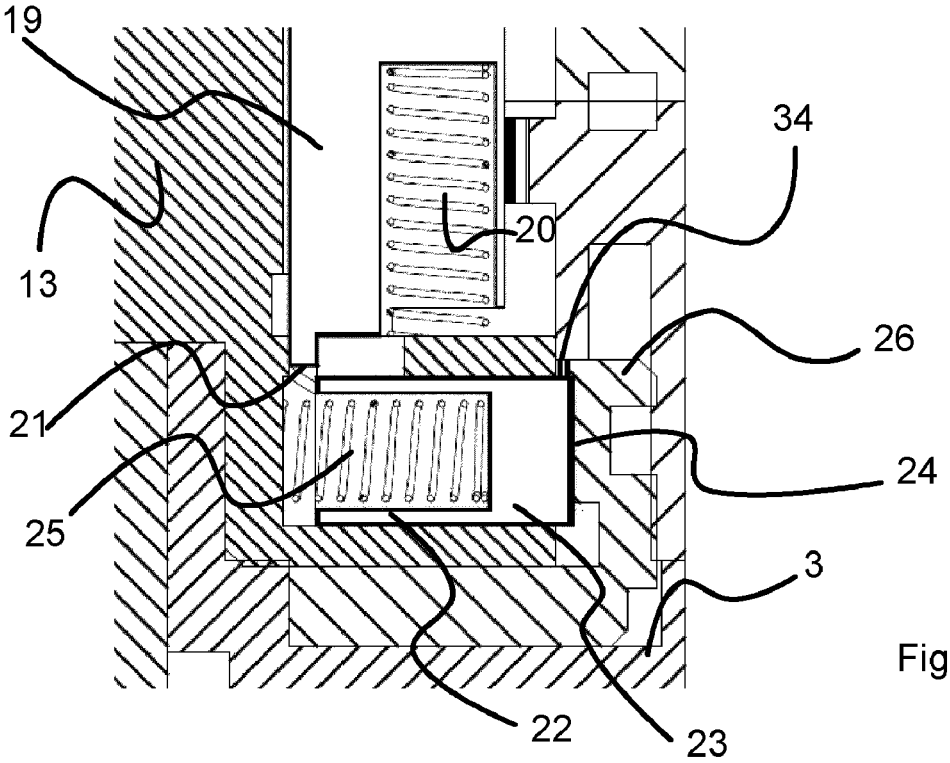

A latch protrusion 21 is arranged at the bottom part of the turret lock slide 19. The latch protrusion 21 is pushed to the open part of the sleeve 22 of a lock element 23 by actuation by the turret cam 17 (FIG. 2*a*). For that purpose, the length of the sleeve 22 is shorter than the length of the spacing between the base and locking ratchet toothing disc 34 located at the saddle 3. Without actuation by the turret cam 17, the latch protrusion 21 is lifted out of the locking engagement by the return spring 20 (FIG. 2*b*).

The sleeve 22 includes a lock pawl 24 at its closed tip having an edge extending parallel to the symmetry axis 12, which engages a locking ratchet toothing located at the saddle 3 through bias by a compression spring 25 supported against the base 13.

When the latch protrusion 21 is in engagement position, the base 13 and the saddle 3 are securely coupled, preventing rotation with respect to each other. A display symbol 9 of a shut padlock is visible in the window 10 of the display disc 11. When the latch protrusion 21 is unengaged, the base 13 adjacent to the saddle 3 is rotatable and can thereby displace the actuator 15. In window 10 of the display disc 11 a display symbol 9 of an open padlock is visible. When the base 13 is rotated, the edge of the lock pawl 24 audibly springs from a locking ratchet tooth at the saddle 3 into the following tooth under bias by the compression spring 25. To prevent wear and tear of the locking ratchet toothing, the shown component 26 of the saddle 3 can be made from a specially adapted material that is harder than the saddle 3 itself.

Figure 3:
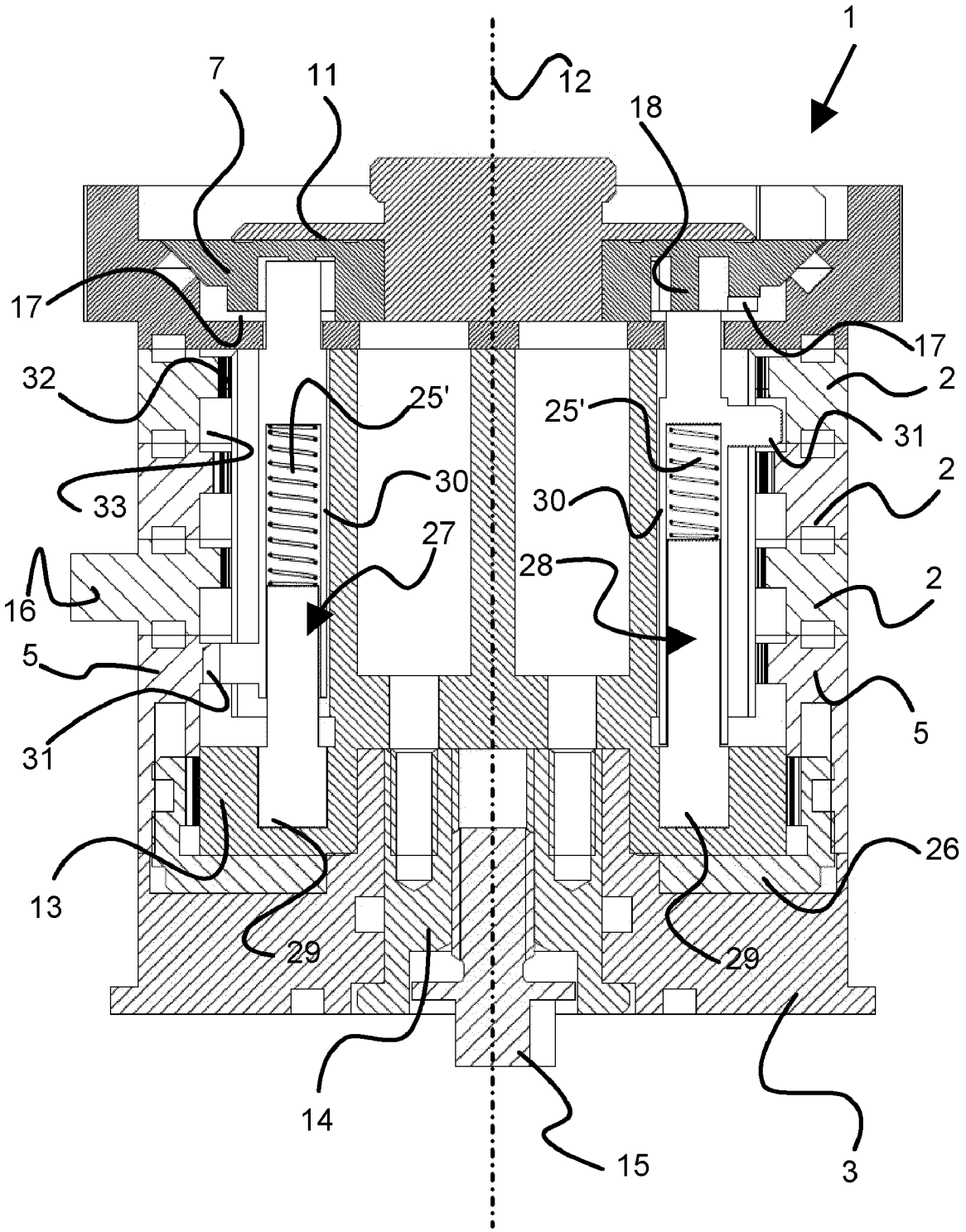

The cross-sectional view through the adjustment turret 1 of FIG. 3 shows a scale ring lock slide 27 and an indicator ring lock slide 28. Both lock slides 27, 28 include a cylindrical pin 29 inserted in the base 13 and a sleeve element 30 sliding thereon. The cylindrical pin 29, as shown in FIG. 3, can include a larger second diameter at the end at the base, for example one fitted to the outside diameter of the sleeve element 30. At the sleeve elements 30, a respective latch protrusion 31 is allocated to one of a scale ring lock slide 27 and indicator ring lock slide 28.

The scale ring 5 and the indicator rings 2 include axially superimposed ratchet lock rings 32 and peripheral grooves 33 at their inner circumferential surface. Seal/slide elements, not shown, can be included between the superimposed surfaces of the scale and indicator rings. For the mechanical centering of the rings (6, 2, 5), the non-depicted seal/slide elements advantageously include a square cross-section, or a rectangular cross-section. The outer surfaces of the rings can overlap each other (FIG. 7, 7*a*), to improve sealing and mechanical centering. The order of the lock rings 32 and peripheral grooves 33 shown in FIG. 3 can also be reversed, whereby the height position of the latch protrusions 31 is to be fitted.

Depending on the rotational setting of the cam disc 7, a cam 18 is engages the upper surface of the sleeve elements 30. The cam 18 is formed such that in the event of rotation of the cam disc 7 it only acts on one of the lock slides 27, 28 at a time. Absent engagement by a cam 18, the respective sleeve element is lifted by a compression spring 25' supported against the smaller diameter of the cylindrical pin 29, wherein the respective latch protrusion 31 engages the respective lock ring 32, as shown at the scale ring lock slide 27. Under engagement of the cam 18, the latch protrusion 31 is pressed into the peripheral groove 33, as illustrated at the scale ring lock slide 28. In the window 10 of the display disc 11, a respective indicator ring 2 display symbol 9 is displayed. Only the indicator ring 2 shown in the display as released can be freely rotated.

Figure 4:
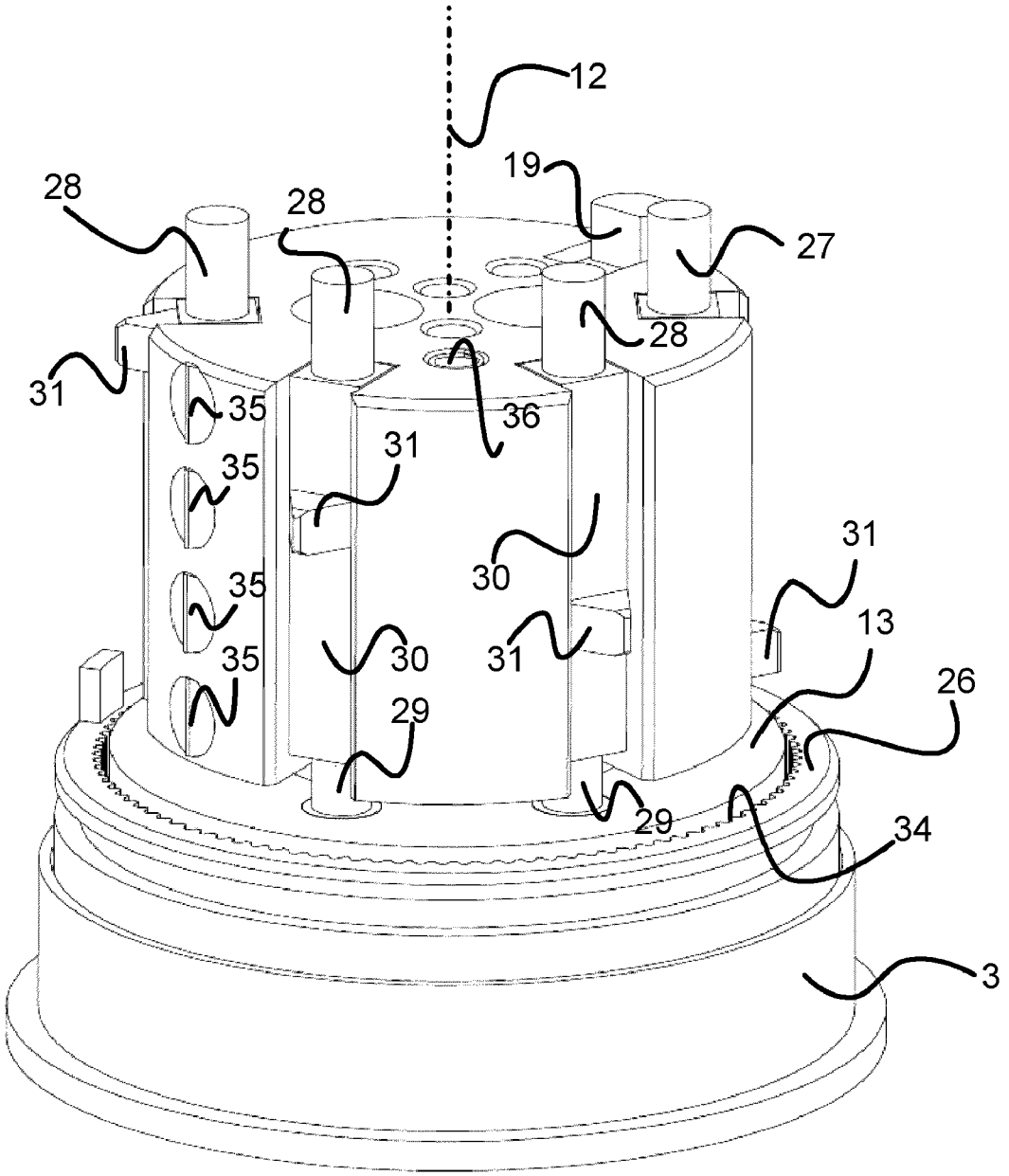

In the perspective view of FIG. 4 of the base 13 with slide locks 19, 27, 28, the arrangement of lock slides in the outer wall surface of the base 13 is shown. The lock slides 19, 27, 28 are fixedly secured at the sleeve element 30 that is at this area angularly shaped, such that the arrangement of the latch protrusions 31 is maintained with the axial displacement of the lock slides. The surface of the turret slide locks 19 and the scale/indicator ring lock slides are arranged on circumferential lines that are concentric to one another, corresponding to the arrangement of the cams 17, 18 at the cam disc 7.

A locking ratchet toothing 34 is provided at an inner surface of the saddle 3, serving the adjustment turret 1 lock previously described prior in FIG. 2, 2*a*, 2*b*.

In the outer circumferential surface of the cylindrical body of the base 13, known click/lock elements 35 are arranged, which engage the lock rings 32 of the scale/indicator rings 2, 5 to prevent rotation and to generate a clicking sound.

Figure 6:
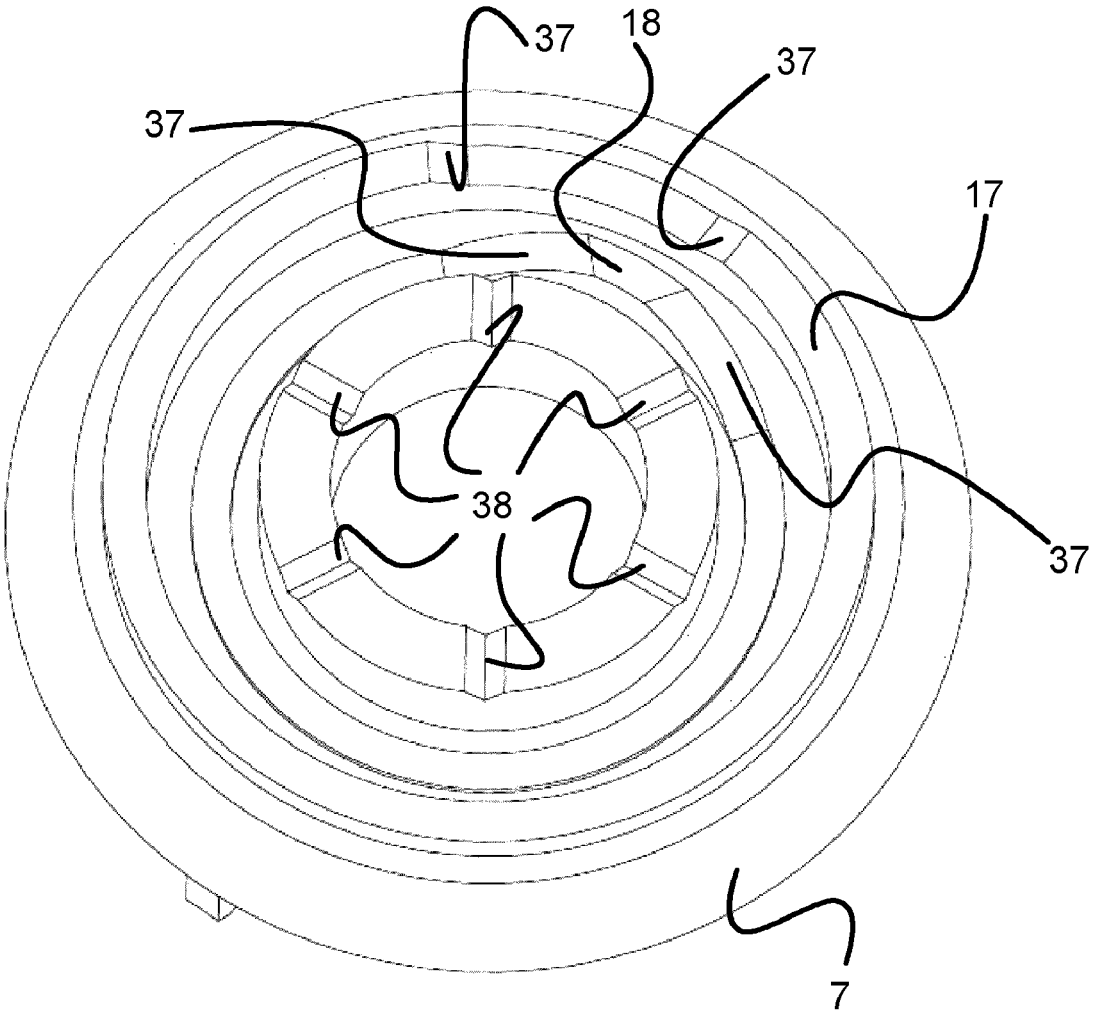

In the upper surface of the base 13 receptacle holes can be provided, in this embodiment only a single bore 36 for a not further illustrated lock element, for example a spring mounted ball, which can work with the ratchet notches 38 depicted in FIG. 6 at the underside of the cam disc 7 for the securing of the rotational setting of the cam disc's rotational position.

Figure 5:
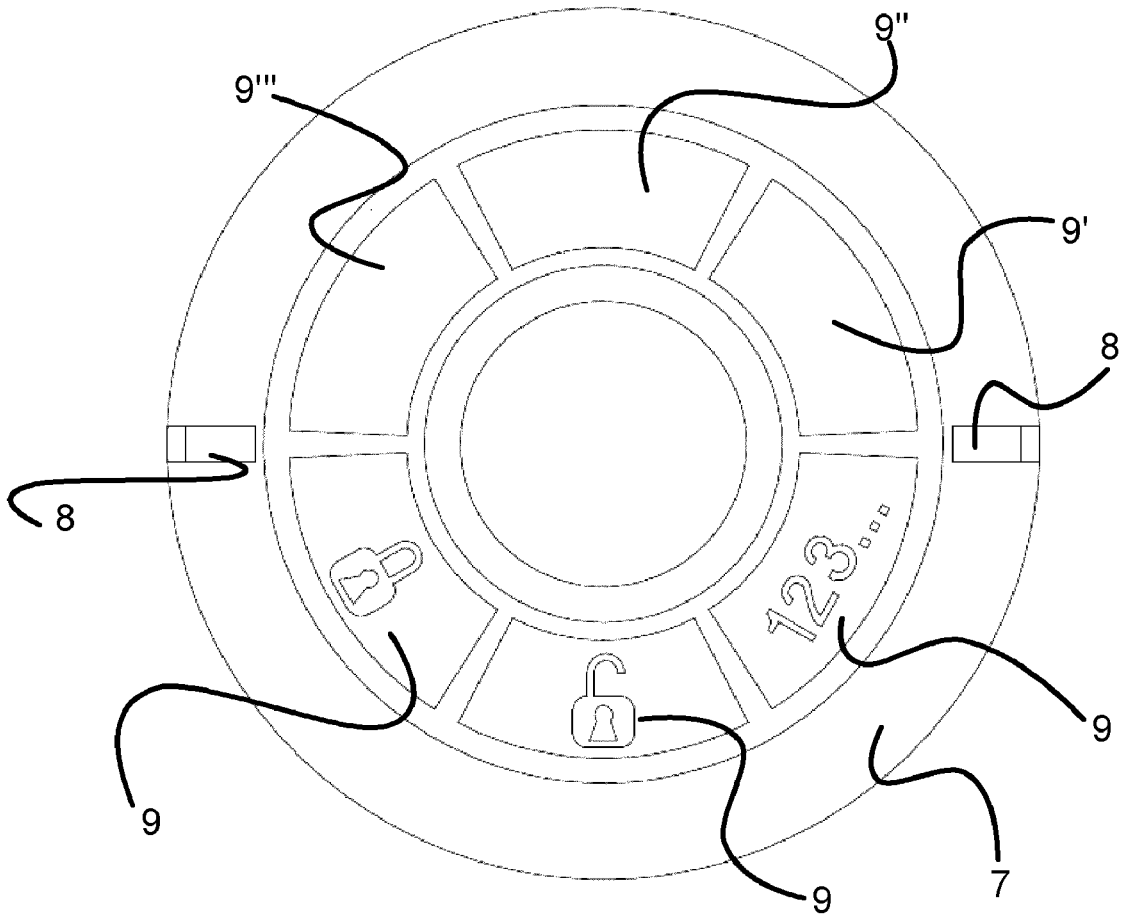

Shown in FIG. 5 is a top view of the upper surface of the cam disc 7 with the zones for the previously described display symbols 9. Colored zones, particularly in the color sequence red (9'), green (9") and blue (9"), can serve as display symbols 9', 9" and 9'". This RBG color sequence is known and advantageously enables also use in darkness, where colors are known to be more difficult to recognize. In this manner a user is enabled to operate, through simple haptics, starting from a $1^{st}$ setting (closed lock symbol, adjustment ring 6—locked), the $2^{nd}$ setting (open lock symbol adjustment ring 6—unlocked), then the $3^{rd}$ setting (adjustable scale ring 5 setting), then the $4^{th}$ setting (adjustable red indicator ring 2 setting) etc.

FIG. 6 shows a perspective view of the underside of the cam disc 7. Cams 17, 18 are provided on circumferential lines concentric to each other and have respective rise/fall ramps 37, to enable smooth rotation of the cam disc 7 in both rotational directions. The turret cam 17 extends virtually over a complete circular ring and is interrupted only in the area between the rise/fall ramps 37. This rotational area serves to unlock the base 13 from the saddle 3. The cam 18 serves to release the scale ring 5 and indicator rings 2. It is arranged such that it does not act on any of the scale/indicator ring lock slides 27, 28 while releasing the base 13 from to the saddle 3, such that these lock slides 27, 28 remain locked during the adjustment of the actuator 15.

Ratchet notches 38 are included in an inner circumference of the underside of the cam disc 7, which in conjunction with the previously described lock elements, for example a spring mounted ball in the bore(s) 36 of the upper surface of the base 13, serves to hold the cam disc 7 at the set display symbols 9, 9', 9", 9'".

Figure 7:
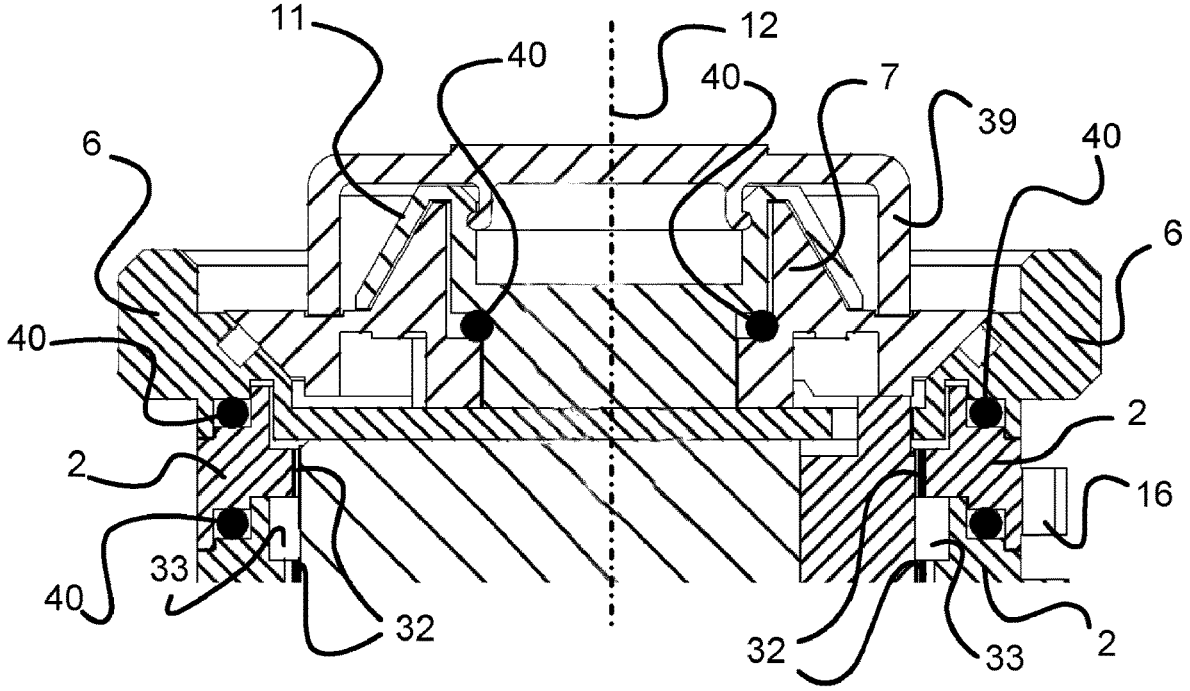

In the detail section of an alternatively configured adjustment turret 1 shown in FIG. 7, the display disc 11 and the upper surface of the cam disc 7 are provided as superimposed conical surfaces that are inclined with the symmetry axis 12. This enables in advantageous fashion a lateral view into the not presently shown window 10 in the display disc 11. A cover cap 39 consists of transparent material and protects the otherwise upward facing open display disc 11 from dirt and other environmental influences.

The uppermost arranged indicator ring 2 is provided for simple gripping with an adjustment protrusion. The indicator rings 2 include axially stacked lock rings 32 and peripheral grooves 33 at their inner peripheral surface. A seal/slide element 40 is included in the space between the adjustment ring 6 and the uppermost indicator ring 2, and included in other functional elements moveable relative to one another. The inner and outer surfaces of the rings (6, 2) include inner and outer overlap and centering sections, in order to center the rings (6, 2, 5) relative to each other and enhance the seal.

Figure 7A:
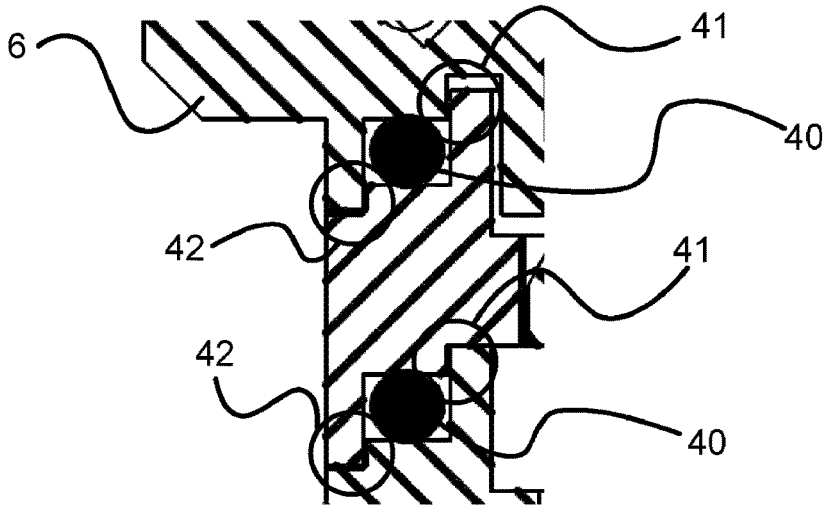

FIG. 7*a* shows in an enlarged detailed sectional view of the area located in FIG. 7 left of the symmetry axis 12. Inner 41 and outer 42 overlap and centering sections are highlighted by circles with reference numerals. Arranged in between these are seal/slide elements 40, implemented as O-rings with a circumferential cross-section.

REFERENCE NUMERAL LIST

1 adjustment turret
2 indicator rings
3 saddle
4 reference marking at saddle 3
5 scale ring
6 adjustment ring
7 cam disc
8 knob at cam disc 7
9, 9', 9", 9'" display symbols on cam disc 7
10 window in display disc 11
11 display disc

12 symmetry axis
13 base
14 threaded fitting
15 actuator
16 setting protrusion at indicator ring 2
17 turret cam
18 scale/indicator ring cam
19 turret lock slide
20 return spring at the turret lock slide 19
21 latch protrusion at the turret lock slide 19
22 sleeve for lock element at turret lock slide
23 lock element between base and saddle
24 lock pawl at sleeve 22
25 compression spring in sleeve for lock element 23
25' compression spring in sleeve for lock slide
26 component with locking ratchet toothing at the saddle
27 scale ring lock slide
28 indicator ring lock slide
29 cylindrical pin in lock slide
30 sleeve element for the lock slide
31 latch protrusion at the lock slide
32 lock ring at scale/indicator ring
33 peripheral groove at the scale/indicator ring
34 locking ratchet toothing at the saddle
35 lock/click elements at base
36 receptacle bore for lock element in base
37 rise/fall ramps at cam
38 ratchet notch in cam disc
39 cover cap
40 seal/slide element
41 inner overlap section
42 outer overlap section

The invention claimed is:

1. An adjustment turret with one or more indicator rings, comprising:

a saddle configured to be mounted to a housing of a rifle scope;

an actuator that is displaceable out of the saddle along a symmetry axis of the adjustment turret in a non-rotatable fashion;

a threaded fitting coupled to a base for the displacement of the actuator, wherein the base is rotatably mounted to the saddle;

an adjustment ring coupled to the base;

a scale ring that is supported on the base in such fashion that the scale ring is lockable and/or rotatable relative to a reference marking arranged on the saddle, wherein the one or more indicator rings are adjustably mounted to the base;

a display disc arranged in an upper surface of the adjustment ring and is coupled to the base, wherein underneath the display disc, a cam disc is provided that is rotatable about the symmetry axis of the adjustment turret, said cam disc comprising at least:

one or more arc-shaped turret cams, and one or more arc-shaped scale/indicator ring cams, wherein each of said turret cams and scale/indicator ring cams faces the base and includes a rise/fall ramp acting in a rotational direction; and at least one rotatably fixed and longitudinally displaceable lock slide arranged parallel to the symmetry axis of the adjustment turret at a circumference of the base, wherein the lock slide is axially displaceable by the one or more arc-shaped turret cams of the cam disc.

2. The adjustment turret of claim 1, wherein the cam disc is manually rotatable relative to the base in the adjustment ring via knobs.

3. The adjustment turret of claim 1, wherein the cam disc includes display symbols sequentially arranged in the rotational direction, wherein each of the display symbols corresponds to a rotational position of the cam disc such that one of the display symbols is visible through a window of the display disc, and wherein the rotational position of the cam disc is displayed across from the base.

4. The adjustment turret of claim 1, wherein the lock slide is configured as a turret lock slide, which is axially displaceable by the one or more turret cams of the cam disc;

a return spring supported against the base acts on the turret lock slide;

a ratchet lock element is supported in the base and biased by a pressure spring into a connection with the saddle, said ratchet lock element extending perpendicularly to the symmetry axis; and the turret lock slide locks the lock element when engaged by the one or more turret cams and releases the lock element when the one or more turret cams are disengaged from said turret lock slide.

5. The adjustment turret of claim 4, wherein the lock element comprises a locking ratchet pawl arranged at a tip of a sleeve and engaging a locking ratchet toothing arranged at the saddle; and the pressure spring is supported against the base and arranged in the sleeve; wherein a length of the sleeve at the turret lock slide is shorter than a space between the base and the locking ratchet toothing for allowing engagement of a latch protrusion with said sleeve.

6. The adjustment turret of claim 4, wherein the one or more scale indicator ring cams are arranged concentrically to the one or more turret cams.

7. The adjustment turret of claim 4, wherein the one or more indicator rings includes a plurality of indicator rings that differ from each other in color on an outer circumferential surface of each of the plurality of indicator rings and each one of the plurality of indicator rings comprises a setting marking.

8. The adjustment turret of claim 7, wherein a manually graspable setting protrusion is mounted to the outer circumferential surface of one of the plurality of indicator rings.

* * * * *